United States Patent [19]

Johansson et al.

[11] 4,307,779

[45] Dec. 29, 1981

[54] PLATE HEAT EXCHANGER

[75] Inventors: Hans Johansson, Lund; Kaj Rissler, Halsingborg; Dag Rynell, Loddekopinge; Malte Skoog; Nils Stadmark, both of Lund, all of Sweden

[73] Assignee: Alfa-Laval AB, Tumba, Sweden

[21] Appl. No.: 55,700

[22] Filed: Jul. 9, 1979

[30] Foreign Application Priority Data

Jul. 10, 1978 [SE] Sweden ..... 7807677

[51] Int. Cl.[3] ..... F28F 3/04

[52] U.S. Cl. ..... 165/166; 165/167

[58] Field of Search ..... 165/146, 147, 166, 167

[56] References Cited

U.S. PATENT DOCUMENTS 3,532,161 10/1970 Lockel .

3,731,737 5/1973 Jenssen ..... 165/167

4,176,713 12/1979 Fisher ..... 165/166

FOREIGN PATENT DOCUMENTS 1064724 5/1954 France ..... 165/166

1211065 11/1970 United Kingdom ..... 165/166

*Primary Examiner*—Sheldon J. Richter

*Attorney, Agent, or Firm*—Cyrus S. Hapgood

[57] ABSTRACT

In a plate heat exchanger, in which the plates are provided with a turbulence generating pattern of grooves and ridges which also form supporting points for plates disposed adjacent to each other, the thermal treatment of a medium will be different in different parts of one and the same passage due to the different length of different flow paths within the passage. In order to equalize the differences of thermal treatment within one and the same passage and/or to provide mutually different treatment of the heat exchanging media, each passage is formed by plates corrugated in a pattern which is unsymmetrical with regard to the central plane of the plates, the ridges and grooves of plates disposed adjacent to each other extending in mutually different directions relative to the longitudinal axis of the plates.

4 Claims, 5 Drawing Figures

PLATE HEAT EXCHANGER

Figure 1:
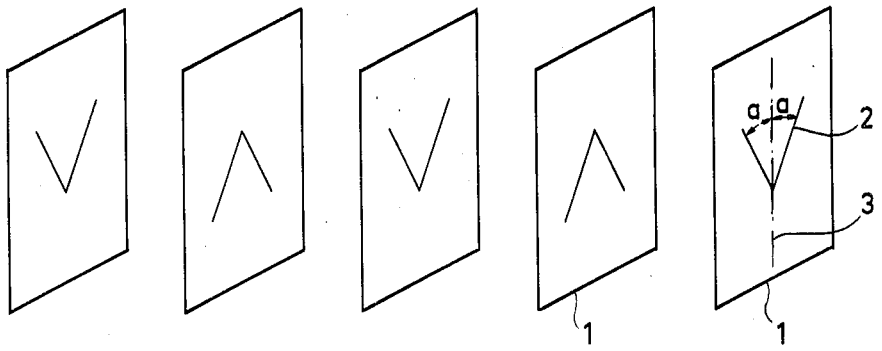

The present invention relates to heat exchangers of the kind comprising a plurality of heat exchanging plates arranged adjacent to each other and forming between them sealed passages adapted for through-flow by two heat exchanging media. More precisely, the invention relates to a plate heat exchanger in which the heat exchanging surfaces of the plates are provided with creases or corrugations which on each side of the plates form a wave-like pattern of ridges and grooves. The primary object of the corrugations is to cause a heavy turbulence of the heat exchanging media.

The plates are usually provided with marginal sealing gaskets and are clamped together in a supporting structure. However, the plates may instead be interconnected permanently, as by welding or soldering, in which case the sealings and supporting structure are omitted.

By letting the corrugations of adjacent plates form an angle relative to each other, a large number of supporting points are also obtained in which the ridges of adjacent plates are in contact with each other. In prior heat exchangers of this kind, the corrugations extend at a fixed angle relative to the longitudinal axis of the plate, and the above-mentioned angle between corrugations of adjacent plates is obtained by turning every other plate 180° in its own plane. Furthermore, the corrugations are made symmetrical with regard to the central plane of the plate, and in addition, the angle of the corrugation relative to the longitudinal axis of the plate is equally large on each side of the center line of the plate.

Due to the symmetrical construction of the plates of the prior heat exchangers, equal thermal properties are obtained in all heat exchanging passages. This is the case even when two kinds of plates are used which are arranged alternately. Further, passages are provided which throughout their entire area present unchanged thermal properties. Thus, the so-called thermal length or heat transfer capability of an element of a passage is equal to the thermal length of another element having the same area and being located in another part of the passage.

However, as is well known, since different flow paths within a passage are not equally long, the portion of a heat exchanging medium taking a longer flow path through the passage will be exposed to a different thermal treatment than the portion of the medium taking a shorter path through the same passage. Since it is desired to obtain equal thermal treatment of the medium irrespective of the flow path through the passage, the above-described state of things is unsatisfactory.

In order to rectify this drawback, it is an object of the present invention to provide heat exchanging passages in which elements located in a longer flow path have less thermal length than equally large elements located in a shorter flow path. In this way a mutual equalization of the total thermal length of flow paths of different lengths can be provided, whereby the thermal treatment of the medium will be the same irrespective of the flow path between the inlet and outlet of the heat exchanging passage.

It is a further object to provide a plate heat exchanger in which the passages for both heat exchanging media may have mutually differing thermal lengths.

In the heat exchanger of the present invention, the above-mentioned objects are fulfilled and at the same time the above-described drawbacks of prior heat exchangers are eliminated. This is achieved by a plate heat exchanger of the above-mentioned kind which is generally characterized in that it comprises passages formed by plates each having a corrugation which is unsymmetrical in relation to the central plane of the plate, the corrugation grooves of both the plates forming a passage extending in mutually differing directions in such way that the angle formed between the grooves and the longitudinal axis of one plate is smaller than the corresponding angle of the other plate.

Figure 5:
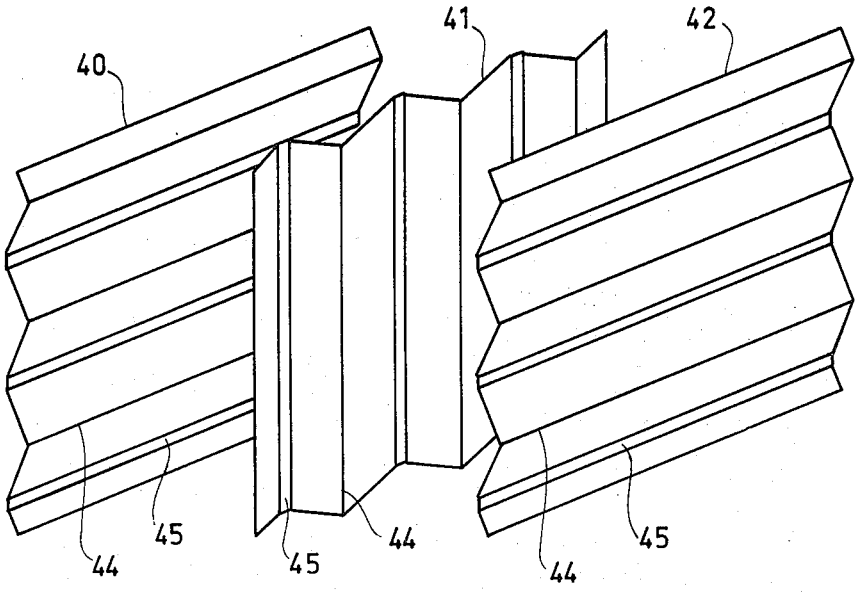
Figure 2:
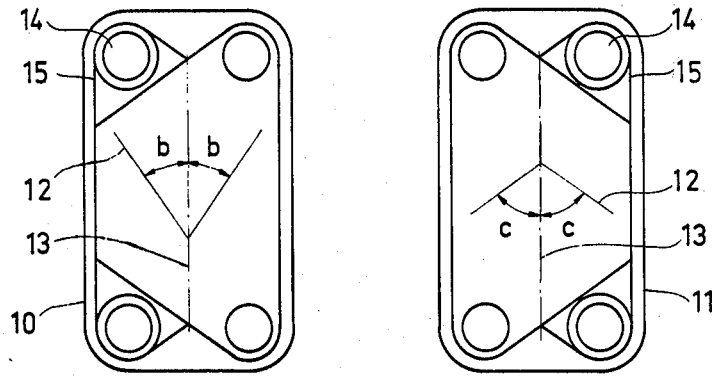
Figure 3:
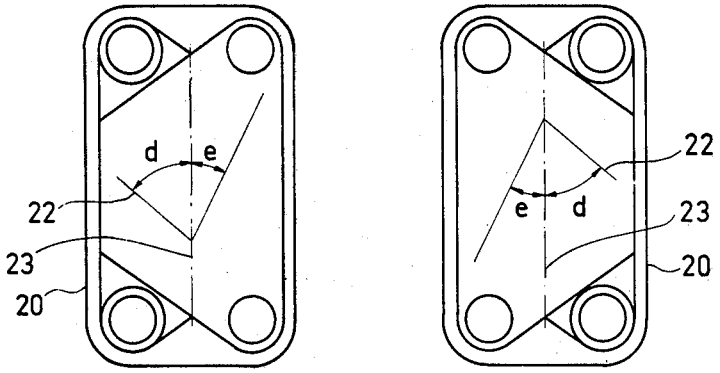
Figure 4:
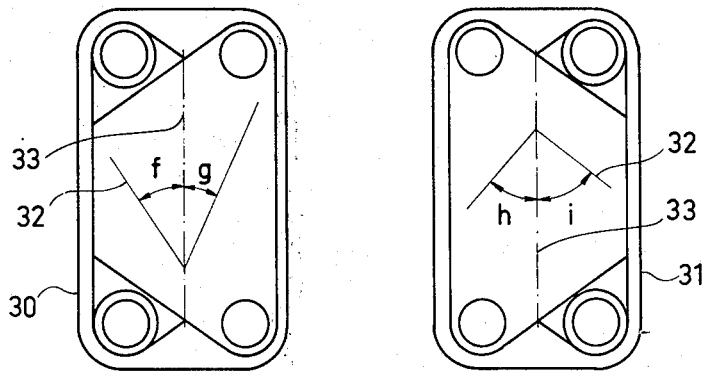

The invention will be described more in detail below with reference to the accompanying drawings, in which FIG. 1 is an exploded, diagrammatical perspective view of a series of conventional heat exchanging plates; FIGS. 2–4 are diagrammatical plan views of different embodiments of heat exchanging plates according to the invention; and FIG. 5 is an exploded, fragmentary perspective view of a series of heat exchanging plates according to the invention.

The conventional heat exchanging plates 1 shown in FIG. 1 are provided with corrugations 2 which are indicated diagrammatically and made in a so-called herringbone pattern. The corrugations form an angle "a" against the longitudinal axis 3 of the plates. This angle is the same on both sides of the center line, as indicated in FIG. 1. In order to obtain a mutual angle between the corrugations of adjacent plates, every second plate is turned 180° in its own plane. In a heat exchanger assembled from such plates, each corrugation of which is completely symmetrical in all respects, the thermal properties of all heat exchanging passages are equal. The thermal properties are also equal on each side of the center line 3 of the plates.

In FIG. 2, two plates 10 and 11 are shown which are made in accordance with the invention. The plates 10 and 11, which are arranged alternately in a heat exchanger, are of two kinds and differ in that the corrugations 12 extend at different angles b and c, respectively, with relation to the longitudinal axis 13. The plates are provided in a conventional way with corner openings 14 and sealing gaskets 15.

The plates 20 shown in FIG. 3 are identical, one of them being turned 180° in its own plane. The plates 20 are each provided with a corrugation 22 which on one side forms a first angle d in relation to the longitudinal axis 23 and on the other side forms a second angle e in relation to the same axis.

The two plates 30 and 31 shown in FIG. 4 are provided with corrugation patterns 32 each presenting different angles on each side of the center line of the plate and also different angles relative to the corrugation of the other plate. The corrugation of the plate 30 thus extends at angles f and g, respectively, in relation to the longitudinal axis 33, and the corresponding angles of the plate 31 are designated h and i.

In FIG. 5, three fragments 40, 41 and 42 of the heat exchanging portion of heat exchanging plates according to any of FIGS. 2–4 are shown. The cross-section of the plates is shown in FIG. 5, where it appears that the corrugation pattern is made unsymmetrical in such a way that the ridges on one side of the plate have sharp creases 44 and on the other side plane portions 45. As appears, all the plates face the same direction and thus have the sharp creases 44 facing forwards in the Figure, the sharp creases 44 of one plate abutting the plane portions 45 of an adjacent plate. In the Figure, the corrugation grooves of adjacent plates extend at right angles to one another, but of course, other mutual angles are also applicable.

Although the volume of the passages formed between plates 40–42 are essentially equal, their thermal properties may still vary due to the flow direction. This is because of the unsymmetrical corrugation pattern of the plates which more or less affects the flow of the media, due to their direction in relation to the grooves of the plates. For instance, if the flow direction in the passage between the plates 40 and 41 is parallel to the grooves of the plate 41, the medium will be subjected to a heavier flow resistance and turbulence than if the flow direction is parallel to the grooves of the plate 40. This state of things is essentially due to the fact that as to each passage between adjacent plates, the two portions of the passage located on each side of a plane through the points of contact of the plates have different volumes due to the unsymmetrical corrugation pattern.

In FIG. 5, supposing that both the media flow in a direction at the same angle to the grooves of all the plates, i.e., 45° , the thermal properties of all the passages will be equal.

As appears from the above, it is possible to adapt the thermal properties of the heat exchanging passages as needed by providing the plates with an unsymmetrical corrugation pattern, such as the kind shown in FIG. 5, and by having the corrugation grooves extend at a suitable angle in relation to the general flow direction of the heat exchanging media.

In this way, it is possible to obtain heat exchanging passages in which an element located in a shorter flow path has a greater thermal length than an element having the same area and located in a longer flow path through the same passage.

In an embodiment according to FIG. 3 or 4, by choosing suitable angles d through i, it is possible to obtain a heat exchanger in which the passages on the side of the center line closest to the inlets and outlets has greater thermal length per unit of area than on the opposite side of the center line. In an embodiment according to FIG. 2 or 4, it is further possible to obtain a heat exchanger in which the thermal properties of the passages for both the heat exchanging media differ mutually.

Further embodiments than those shown on the drawings are also possible within the scope of the invention. Thus, the unsymmetry of the corrugation pattern may be different on two adjacent plates. Furthermore, the grooves of the corrugation need not be broken along the center line of the plates, as is shown in the figures, but can be broken along several lines, for example.

We claim:

1. A heat exchanger comprising a plurality of heat exchanging plates arranged adjacent to each other and forming between them sealed passages for through flow of two heat exchanging media, each plate having a longitudinal axis and also having a corrugation forming ridges and grooves on opposite sides of the plate, the ridges having crests, said grooves of each plate forming an angle with said longitudinal axis, each plate having a central plane from which said crests on opposite sides of the plate are equally spaced, said corrugation of each plate being unsymmetrical relative to said central plane to provide the grooves of each plate with a different shape on one side of the plate than on the other side, the corrugation grooves of each plate having a larger volume on one side of the plate than on the other side, the corrugation grooves of both the plates which form a passage extending in mutually different directions in such a manner that said angle of one plate is smaller than the corresponding angle of the other plate.

2. The exchanger of claim 1, in which the corrugation grooves are broken along the center line of the plates.

3. The exchanger of claim 2, in which the angle formed between the corrugation grooves and the center line of a plate is different on opposite sides of said line.

4. The exchanger of claim 2, in which said corrugation grooves and ridges of each plate form a herringbone pattern, the apices of the herringbones being located on said longitudinal axis of each plate.

* * * * *